US006398566B1

(12) United States Patent
Chen

(10) Patent No.: US 6,398,566 B1
(45) Date of Patent: Jun. 4, 2002

(54) FOLDABLE ELECTRIC PLUG CONNECTOR

(75) Inventor: Chen-Chun Chen, Taoyuan Shien (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 09/826,217

(22) Filed: Apr. 4, 2001

(30) Foreign Application Priority Data

Jan. 8, 2001 (TW) ..... 90200317 U

(51) Int. Cl.[7] ..... H01R 13/44
(52) U.S. Cl. ..... 439/131; 439/174
(58) Field of Search ..... 439/131, 172, 439/174, 640

(56) References Cited

U.S. PATENT DOCUMENTS 5,401,178 A * 3/1995 Liu ..... 439/131

* cited by examiner

*Primary Examiner*—Tho D. Ta

(57) ABSTRACT

A foldable electric plug connector is provided. The foldable electric plug connector includes an enclosure member having a concave storage confinement disposed thereon for storing a pair of external connection plugs, wherein the concave storage confinement includes an engaging opening formed on the lower portion thereof and two inserting openings formed on two opposite sides of the lower portion, a rotatable transverse rod, an engaging member extending outwardly from the enclosure member through the engaging opening for engaging with the rotatable transverse rod, an immobile connection member including a pair of internal connection pins respectively inserted into the inserting openings, and a foldable connection member including the pair of external connection plugs respectively pivotally connected to the internal connection pins, wherein the rotatable transverse rod is disposed between the two connecting points of the pair of internal connection pins and the pair of external connection plugs.

10 Claims, 5 Drawing Sheets

FOLDABLE ELECTRIC PLUG CONNECTOR

FIELD OF THE INVENTION

The present invention is related to an electric plug connector, and more particularly to a foldable electric plug connector.

BACKGROUND OF THE INVENTION

Generally, an electric plug connector includes an enclosure means, a pair of connection plugs and an electric circuit contained inside the enclosure means. The connection plugs are used to make an electrical connection between an external power source and a circuit contained inside the enclosure means. Certainly, the design of the structure of the enclosure means and the layout of the circuit are used to meet the requirement of the application of the electric plug connector. In other words, the structures of the enclosure means and the layouts of the circuit are quite different for different electric devices, e.g. adaptor, charger or shaver. According to the prior art, the connection plugs are disposed fixedly on one side of the enclosure means. However, when the electric plug connector is not in use, it is easy for the user to be hurt by the electric plug connector if the user is not careful enough. Moreover, because of fixing of the electric plug connector, an extra space is required for disposing the electric plug connector on the enclosure means. Thus, at present, a lot of researches devote to developing a foldable electric plug for solving the problems as described above. FIGS. 1(*a*) and 1(*b*) respectively illustrate an assembled structure and a cross-sectional view of a traditional foldable electric plug connector. Such a foldable electric plug connector includes an enclosure means 10, a pair of external connection plugs 11, a pair of internal connection pins 12 and a rotatable transverse rod 13. The enclosure means 10 further includes a concave storage confinement 101 disposed near the top edge of the enclosure means 10. The holes 111 disposed on the external connection plugs 11 and the holes 121 disposed on the internal connection pins 12 are used for the tenons 131 being inserted thereinto such that the external connection plugs 11, the internal connection pins 12 and the rotatable transverse rod can be stably coupled together. The right and the left side walls of the concave storage confinement 101 respectively includes a spring receptacle 1011 therein for containing a spring 1012. The two ends of the spring 1012 respectively contact with a side of the spring receptacle 1011 and a fixing element 1013. Because of the resilient force of the spring 1012, after the external connection plugs 11 are completely unfolded from the concave storage confinement 12 with simultaneous rotation of the rotatable transverse rod 13, the fixing element 1013 can be engaged with a cavity 1014 of the external connection plug 11. Certainly, thereafter, the external connection plugs 11 can be plugged into an external power supply source for making an electrical connection between the external power supply source and a circuit contained inside the enclosure means 10.

In spite of that a foldable electric plug connector is developed, such a traditional foldable electric plug connector still has some drawbacks described as follows.

1. Besides an enclosure means 10, a pair of external connection plugs 11, a pair of internal connection pins 12 and a rotatable transverse rod 13, a pair of springs 1012 and a pair of fixing elements 1013 are required for assembling the foldable electric plug connector, that is to say, ten elements are required for assembling the foldable electric plug connector and the manufacturing cost of the foldable electric plug connector would be raised.

2. The process for assembling the foldable electric plug connector is complicated.

3. The external connection plugs 11 and the internal connection pins 12 are easily detached from the tenon 131.

Accordingly, it is attempted by the present applicant to overcome the above-described problems encountered in the prior arts.

SUMMARY OF THE INVENTION

An object of the present invention is to provide a foldable electric plug connector for lowing the manufacturing cost thereof.

Another object of the present invention is to provide a foldable electric plug connector for easily being assembled.

A further object of the present invention is to provide a foldable electric plug connector with less elements for saving the required laboring.

According to the present invention, the foldable electric plug connector includes an enclosure means having a concave storage confinement disposed thereon for storing a pair of external connection plugs, wherein the concave storage confinement includes an engaging opening formed on the lower portion thereof and two inserting openings formed on two opposite sides of the lower portion, an engaging means extending outwardly from the engaging opening for engaging with a rotatable transverse rod, an immobile connection means including a pair of internal connection pins, wherein the internal connection pins are respectively inserted into the inserting openings for electrically contacting with an electric circuit contained inside the enclosure means, and a foldable connection means including the pair of external connection plugs for being plugged into a power supply, wherein the external connection plugs are respectively pivotally connected to the internal connection pins, wherein the rotatable transverse rod is disposed between the two connecting points of the pair of internal connection pins and the pair of external connection plugs.

Preferably, the enclosure means is made of insulating material.

Preferably, engaging means is integrally formed with the enclosure means and in the shape of an arc. Preferably, one end of the engaging means further includes a protruding member.

Preferably, the rotatable transverse rod further includes a plurality of engaging members, corresponding to the protruding member, for securely engaging with the protruding member in position without movements.

Preferably, each external connection plug is pivotally connected to the respective internal connection pin via a rivet.

Preferably, each external connection plug further includes a semicircular head at one end thereof.

Preferably, the rotatable transverse rod further includes a pair of reception members formed at both ends thereof for receiving the semicircular heads.

Preferably, the immobile connection means further includes a pair of hooking members disposed on the pair of internal connection pins for immobilizing the internal connection pins on the enclosure means when the internal connection pins are inserted into the inserting openings.

The present invention may best be understood through the following description with reference to the accompanying drawings, in which:

BRIEF DESCRIPTION OF THE DRAWING

FIG. 1(*b*) is a schematic diagram illustrating a cross-sectional view of a traditional foldable electric plug connector;

DETAILED DESCRIPTION OF THE PREFERRED EMBODIMENTS

Figure 1A:
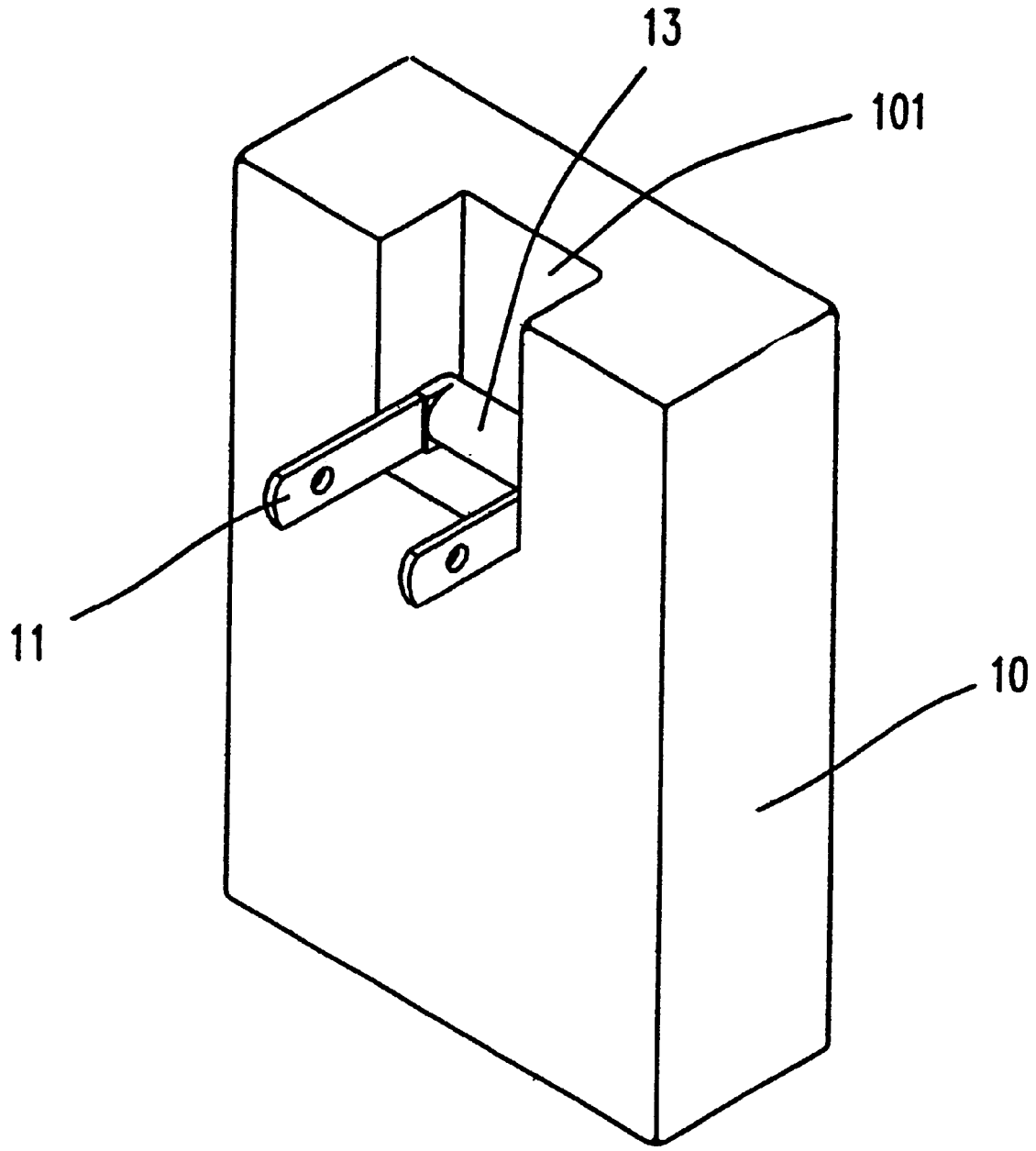
Fig. 1(a)(PRIOR ART)
FIG. 1(*a*) is a schematic diagram illustrating an assembled structure of a traditional foldable electric plug connector.
Figure 1B:
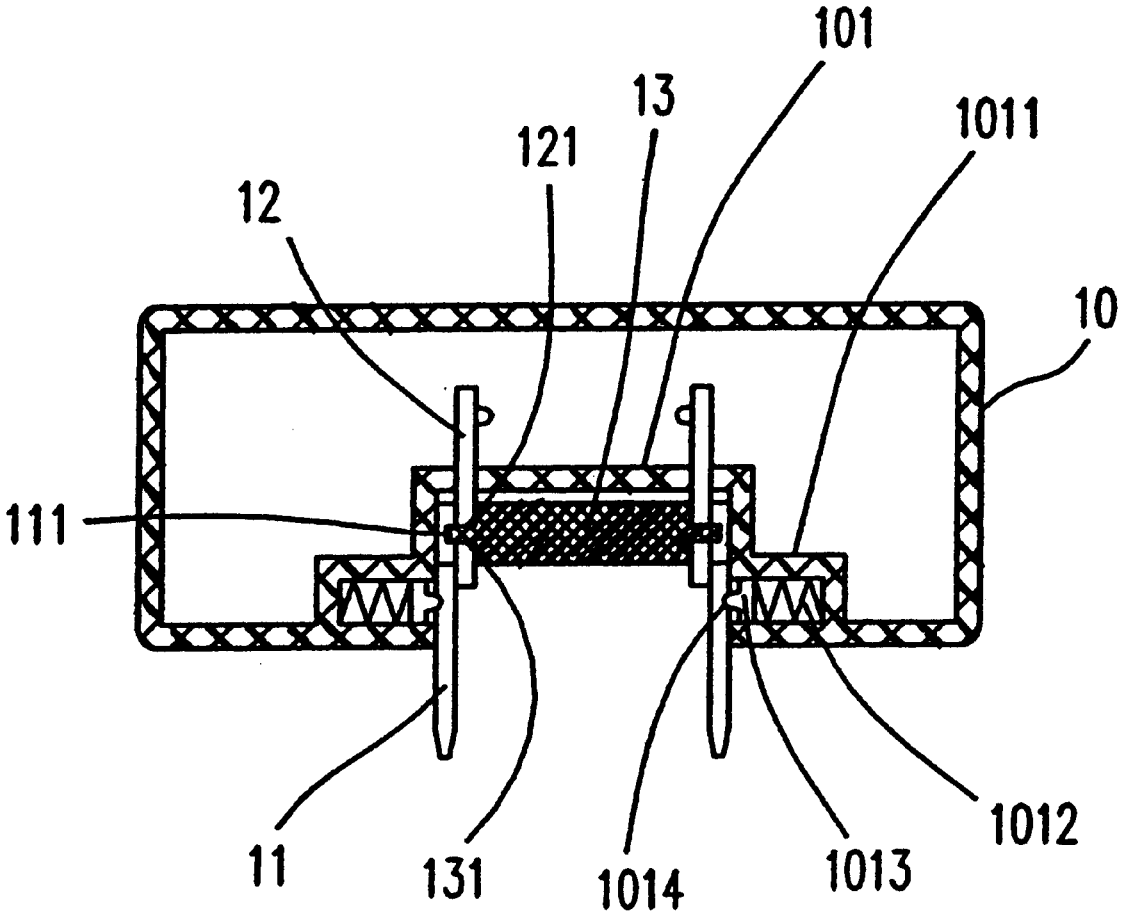
Fig. 1(b)(PRIOR ART)
Figure 2:
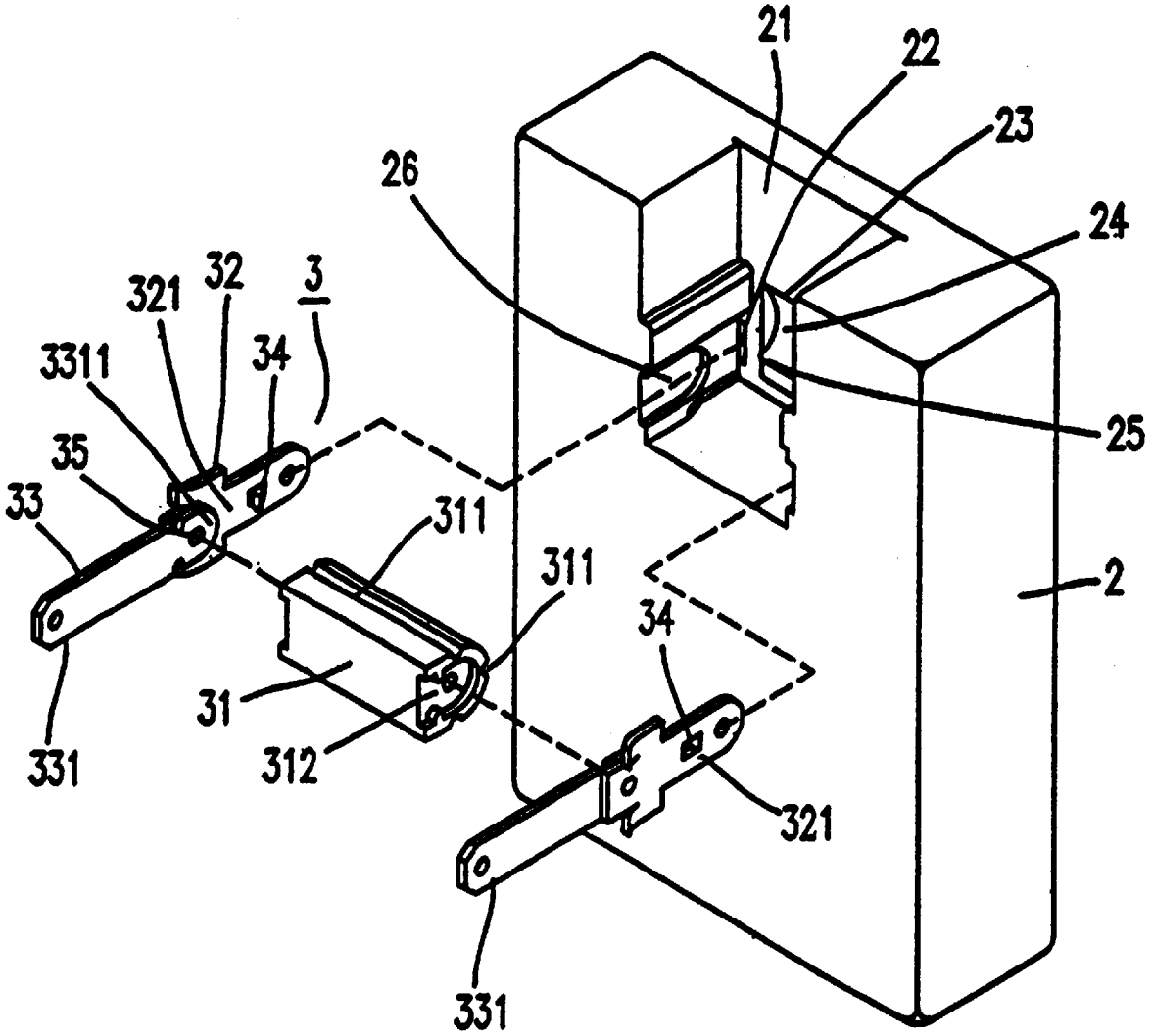
FIG. 2 is a schematic diagram illustrating an exploded diagram of a foldable electric plug connector according to the present invention.
Figure 3:
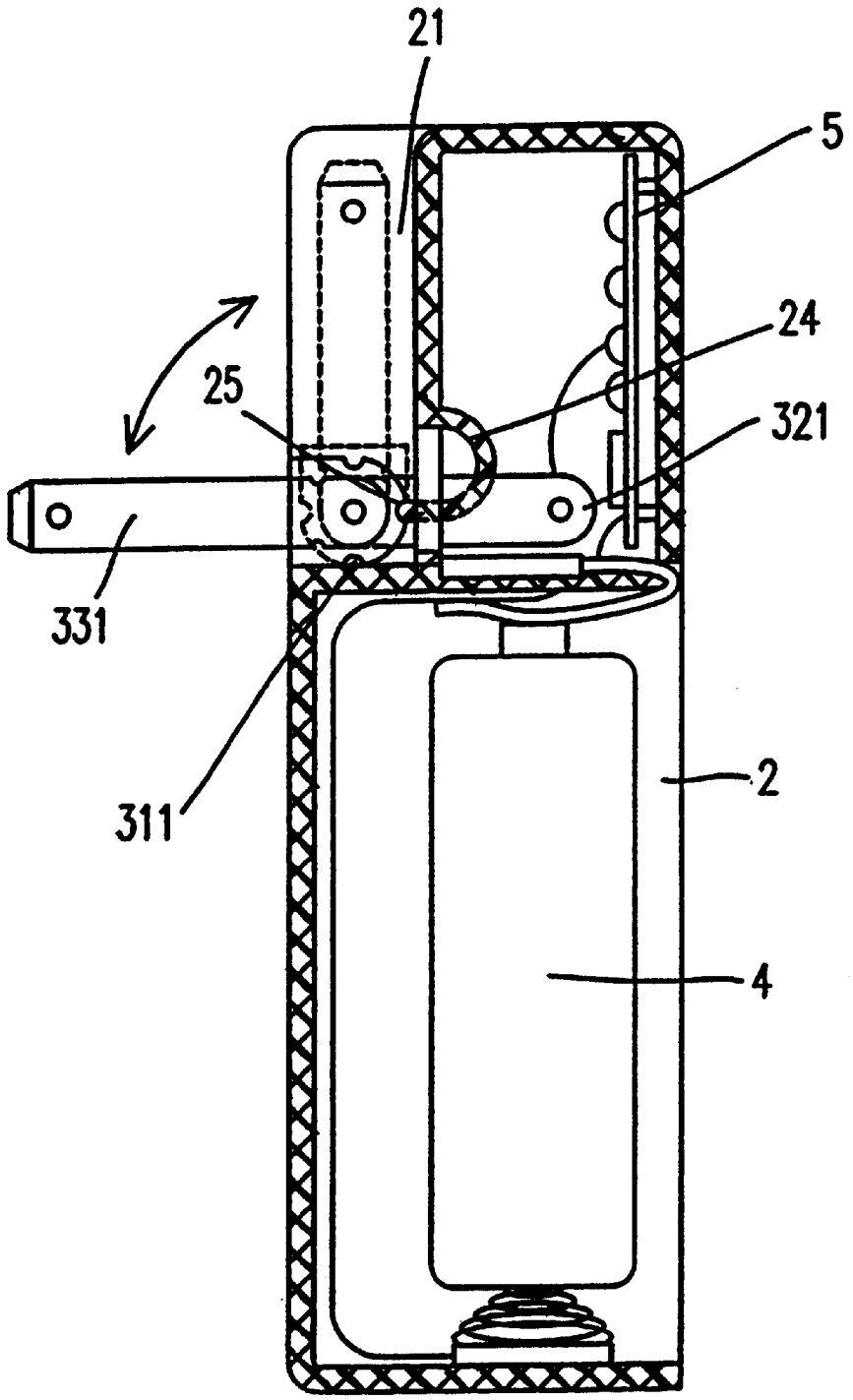
FIG. 3 is a schematic diagram illustrating a cross-sectional view of a foldable electric plug connector according to the present invention.

Please refer to FIG. 2 and FIG. 3 which are schematic diagrams respectively illustrating an exploded diagram and a cross-sectional view of a foldable electric plug connector according to the present invention. According to the present invention, the foldable electric plug connector includes an enclosure means 2 and a plug assembly 3. Preferably, the enclosure means 2 is made of insulating material for protecting a circuit 5 and a battery 4 contained inside the enclosure means 2.

The plug assembly 3 includes an immobile connection means 32 composed of a pair of internal connection pins 321, a foldable connection means 33 composed of a pair of external connection plugs 331, and a rotatable transverse rod 31. The immobile connection means 32 further includes a pair of hooking member 34 disposed on the pair of internal connection pins 321 for immobiling the internal connection pins on the enclosure means 2 when the internal connection pins 321 are inserted into the inserting openings 22. A concave storage confinement 21 is formed on the enclosure means 2 for storing the external connection plugs 331. The concave storage confinement 21 further includes an engaging opening 23 formed on the lower portion thereof and two inserting openings 22 formed on opposite sides of the lower portion. An engaging means 24, integrally formed with the enclosure means 2, is extended outwardly from the engaging opening 23 for engaging with the rotatable transverse rod 31. Preferably, the engaging means 24 is formed in the shape of an arc such that a resilient force is produced thereon and the engaging means 24 can thus be completely engaged with the rotatable transverse rod 31.

The external connection plug 331 is pivotally connected to the internal connection pin 321 via a rivet 35. The external connection plug 331 further includes a semi-circular heads 3311 at one end thereof. A pair of reception members 312 are formed at both ends of the rotatable transverse rod 31 for receiving the semi-circular heads 3311 of the external connection plugs 331.

One end of the engaging means 24 further includes a protruding member 25. There are plural engaging members 311 formed on the transverse rod 31, corresponding to the protruding member 25, for securely engaging with the protruding member 25.

To assemble the foldable electric plug connector, the foldable connection means 33 and the immobile connection means 32 which are riveted together in advance are coupled with the rotatable transverse rod 31 first by jamming the semi-circular heads 3311 of the external connection plugs 331 into the reception members 312. Thereafter, by gradually sliding the external connection plugs 331 into the sliding recesses 26, the plug assembly 3 can be securely immobilized in the concave storage confinement 21 after the hooking members 34 are inserted into the inserting openings 22. When the external connection plugs 331 are plugged into an external power supply source, an electrical connection between the external power supply source and the circuit 5 contained inside the enclosure means 2 is then established.

Figure 4:
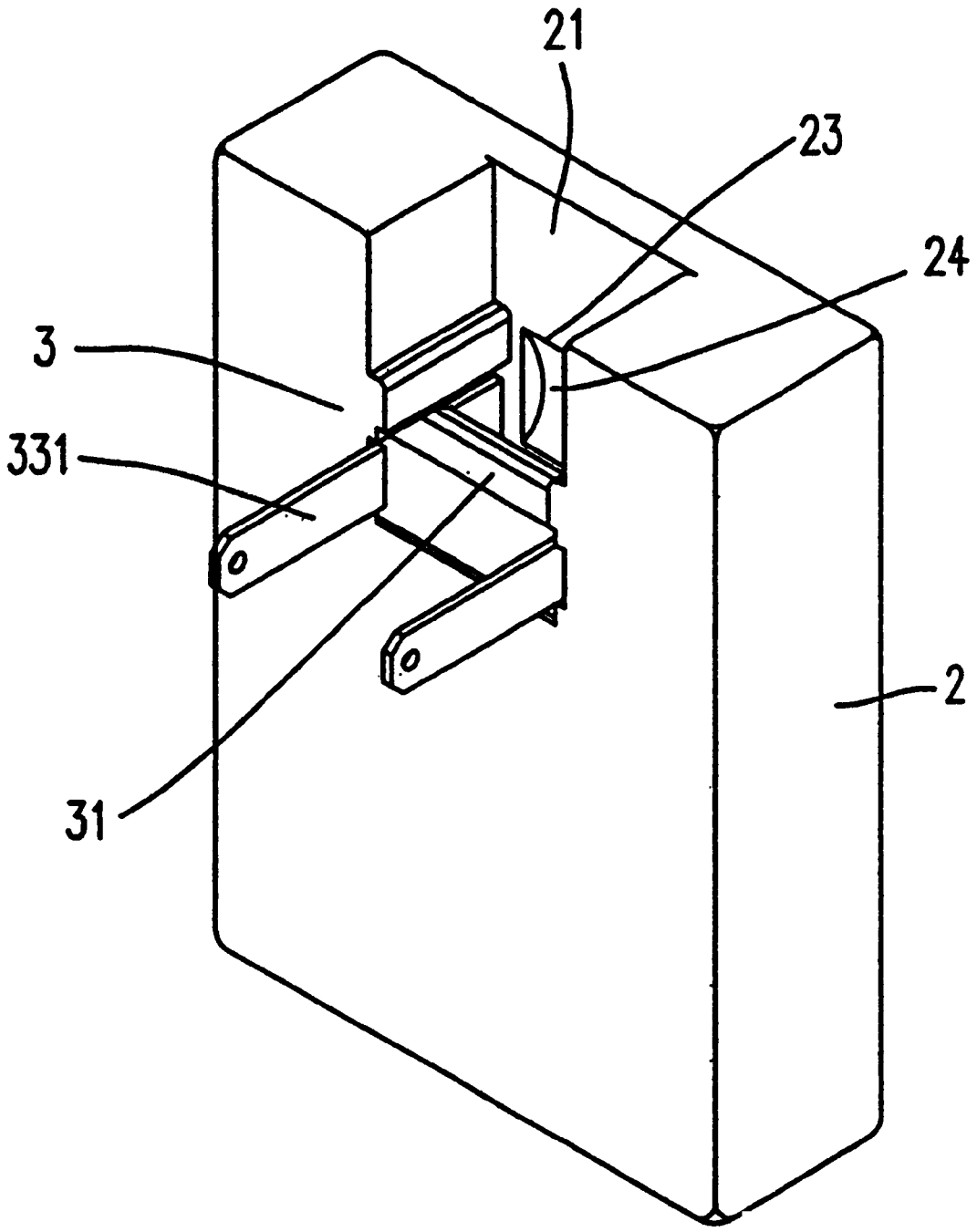
FIG. 4 is a schematic diagram illustrating an assembled structure of a foldable electric plug connector according to the present invention.

Please refer to FIG. 4 which is a schematic diagram illustrating an assembled structure of a foldable electric plug connector according to the present invention. Since a resilient force is produced by the engaging means 24, the rotatable transverse rod 31 and the engaging means 24 can be tightly engaged together at any time. When the external connection plugs 331 are folded into or unfolded from the concave storage confinement 21, the rotatable transverse rod 31 is simultaneously rotated with the external connection plugs 331 with the internal connection pins 321 being securely immobilized in the concave storage confinement 21. Once the external connection plugs 331 are completely folded into or unfolded from the concave storage confinement 21, the engaging member 311 is securely engaged with the protruding member 25 in position without movements.

According to the present invention, fewer elements are required to assemble the foldable electric plug connector. Certainly, the required laboring is saved and the manufacturing cost is lowered. The foldable electric plug connector can be assembled either manually or automatically by an automatic assembling machine. Additionally, space saving can be achieved when the foldable electric plug connector is folded into the concave storage confinement. On the ground of such a simple designed structure, the tight engagement between the assembled elements can also be achieved.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A foldable electric plug connector, comprising:

an enclosure means having a concave storage confinement disposed thereon for storing a pair of external connection plugs, wherein said concave storage confinement comprises an engaging opening formed on the lower portion thereof and two inserting openings formed on two opposite sides of said lower portion;

a rotatable transverse rod;

an engaging means extending outwardly from said enclosure means through said engaging opening for engaging with a said rotatable transverse rod, wherein said engaging means is integrally formed with said enclosure means such that said engaging means and said enclosure means form a one piece configuration;

an immobile connection means comprising a pair of internal connection pins, wherein said internal connection pins are respectively inserted into said inserting openings for electrically contacting with an electric circuit contained inside said enclosure means; and a foldable connection means comprising said pair of external connection plugs for being plugged into a power supply, wherein said external connection plugs are respectively pivotally connected to said-internal connection pins, wherein said rotatable transverse rod is disposed between the two connecting points of said pair of internal connection pins and said pair of external connection plugs.

2. The foldable electric plug connector according to claim 1 wherein said enclosure means is made of insulating material.

3. The foldable electric plug connector according to claim 1 wherein each said external connection plug is pivotally connected to said respective internal connection pin via a rivet.

4. The foldable electric plug connector according to claim 1 wherein said immobile connection means further comprises a pair of hooking members disposed on said pair of internal connection pins for immobilizing said internal connection pins on said enclosure means when said internal connection pins are inserted into said inserting openings.

5. The foldable electric plug connector according to claim 1 wherein said engaging means is in the shape of an arc.

6. The foldable electric plug connector according to claim 5 wherein one end of said engaging means further comprises a protruding member.

7. The foldable electric plug connector according to claim 6 wherein said rotatable transverse rod further comprises a plurality of engaging members, corresponding to said protruding member, for securely engaging with said protruding member in position without movements.

8. The foldable electric plug connector according to claim 1 wherein each said external connection plug further comprises a semi-circular head at one end thereof.

9. The foldable electric plug connector according to claim 8 wherein said rotatable transverse rod further comprises a pair of reception members formed at both ends thereof for receiving said semi-circular heads.

10. A foldable electric plug connector, comprising:

an enclosure having a concave storage confinement disposed thereon and configured to store a pair of external connection plugs, wherein the concave storage confinement comprises an engaging opening formed on the lower portion thereof and two inserting openings formed on two opposite sides of the lower portion;

a rotatable transverse rod;

an engaging portion extending outwardly from the enclosure through the engaging opening and configured to engage with the rotatable transverse rod, wherein the engaging portion is integrally formed with the enclosure such that the engaging portion and the enclosure constitute a one piece configuration;

an immobile connection portion comprising a pair of internal connection pins, wherein the internal connection pins are respectively inserted into the inserting openings configured to electrically contact with an electric circuit contained inside the enclosure; and a foldable connection portion comprising the pair of external connection plugs and adapted to be plugged into a power supply, wherein the external connection plugs are respectively pivotally connected to the internal connection pins, wherein the rotatable transverse rod is disposed between the two connecting points of the pair of internal connection pins and the pair of external connection plugs.

* * * * *